US005233898A

United States Patent [19]

Montano

[11] Patent Number: 5,233,898

[45] Date of Patent: Aug. 10, 1993

[54] DRUM DAMPER EMPLOYING CUSHION HELD BY ADJUSTABLE STRAPS IN OFF-CENTER POSITION AGAINST HEAD AND SHEEL

[76] Inventor: Anthony Montano, 233 Belmar, Daly City, Calif. 94015

[21] Appl. No.: 894,845

[22] Filed: Jun. 5, 1992

[51] Int. Cl.[5] ..... G10D 13/02

[52] U.S. Cl. ..... 84/411 M; 84/453; 181/207

[58] Field of Search ..... 84/411 M, 400, 453; 181/207

[56] References Cited

U.S. PATENT DOCUMENTS 4,520,709 6/1985 Kester, Jr. ..... 84/411 M X
4,589,323 5/1986 Belli et al. ..... 84/411 M
4,745,839 5/1988 Peraino ..... 84/411 M
5,107,741 4/1992 Beals et al. ..... 84/411 M

*Primary Examiner*—Michael L. Gellner
*Assistant Examiner*—P. Stanzione
*Attorney, Agent, or Firm*—David Pressman

[57] ABSTRACT

A drum damper for reducing drum overtones comprises a soft cushion (11) attached to a dense foam body (10). Anchors (16) attached to the inside of a drum by existing screws (23) allow a fastening strap (15) to hold the foam body, which has a sloped rear portion (12), securely inside the drum. The body urges the cushion in compression against the drum heat (22). The strap can be adjusted to control the amount of force it exerts against the sloped rear portion so as to control the force the body exerts against the cushion, and hence the cushion against the drum head. The tighter the cushion is compressed against the drum head, the greater the overtone reduction.

7 Claims, 2 Drawing Sheets

DRUM DAMPER EMPLOYING CUSHION HELD BY ADJUSTABLE STRAPS IN OFF-CENTER POSITION AGAINST HEAD AND SHEEL

BACKGROUND

1. Field of Invention:

This invention relates generally to devices for altering the tonal characteristics of drums, specifically to an improved drum damper.

2. Prior Art:

The base drum is used in mot jazz and rock bands. It comprises a cylindrical wooden frame, shell, or counterhoop, about 1 meter in diameter and about ½ meter long, with each end covered by a taut "skin" or head. Bass drums are usually positioned with the heads vertical and are struck with a foot pedal operated beater—a pivoted arm with a padded head.

An ideal base drum, when struck by its beater, should produce the desired fundamental tones. Actual drums produce overtones, or harmonics, which are tones composed of the fundamentals and additional tones at higher frequencies. These are usually considered undesirable by most musicians since they make the overall sound hollow and reverberatory—an unwanted effect in most popular bands. However, drummers sometimes want some amount of overtones to suit personal tastes and the acoustics of the playing environment. In their efforts to control, reduce or eliminate the overtones and obtain a desirable sound, drummers place damping materials, such as pillow, foam blocks, or towels inside their drums and against the drum heads, or the drum surfaces. Drummers hold these damping materials against the vertically positioned drum heads with heavy objects, such as bricks and iron weights. Although effective at reducing overtones, this method is unreliable because the damping materials gradually shift during drum play and eventually become ineffective. Therefore, the damping materials require frequent repositioning to maintain their effectiveness. In addition, this method cannot be used on horizontally positioned drum heads because the tops are usually struck, yet there are no existing means to support the damping materials from below such top head.

A method more sophisticated than weighted down pillows is shown in U.S. Pat. No. 4,589,323 to Belli et al. (1986), where a circular base with multiple apertures and sheets of foam are used to reduce the overtones of a drum and muffle the volume for practice sessions. Although this device is effective at muffling the drum's sound intensity, it is not effective enough at reducing overtones, i.e., still leaves the drum with too hollow a sound, while it provides no means to adjust the amount of overtone reduction. Moreover, this device is unsuitable for actual performances, because these require reduced overtones without reduced volume.

In conclusion, the present "home brew" method for overtone reduction is effective but unreliable, while the patented device provides a fixed but insufficient amount of overtone reduction, and produces an undesirable and significant volume reduction.

OBJECTS AND ADVANTAGES

Accordingly, several objects and advantages of the invention are to provide a drum damper which can significantly reduce overtones, which can be easily adjusted for varying degrees of overtone reduction to suit personal tastes and the acoustics of the playing environment, which does not appreciably decrease the sound volume, which is reliable and consistent in performance, which is durable, compact, can be easily installed or removed, and is simple and economical to manufacture.

Further objects and advantages will become apparent from a study of the following description and the accompanying drawings.

DRAWING FIGURES

DRAWING REFERENCE NUMERALS

10. Body
11. Cushion
12. Slope
13. Fabric Case
14. Fabric Case
15. Fastening Strap
15E. Ends
16. Anchor
17. Forward Portion
18. Rearward Portion
19. Leg
20. Drum
21. Drum Shell
22. Drum Head
23. Screws
24. Clamps
25. Hoop
26. Hole

DESCRIPTION—FIGS. 1A AND 1B

Figure 1A:
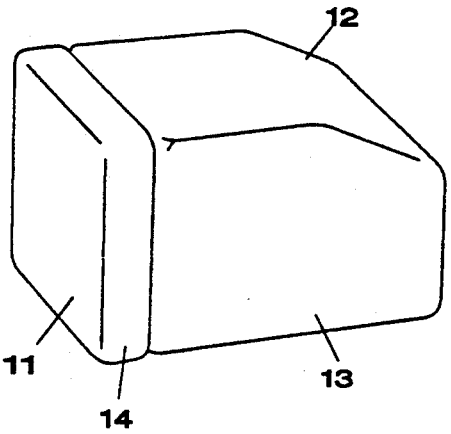
FIG. 1A is a perspective view of a drum damper in accordance with the invention.

In accordance with a preferred embodiment of the invention shown in FIG. 1A, a drum damper comprises a main body 10 and a cushion 11 attached to its left or front end. Body 10 is a rectangular block of dense foam with a sloped portion 12 at the upper rear. Cushion 11 is a thick, soft pillow with a polyester/cotton filling, and is of the same cross section as body 10. Body 10 is thus more rigid than cushion 11. Body 10 serves as a semi-rigid support for cushion 11, which is the actual damping device. Body 10 and cushion 11 are covered with strong fabric cases 13 and 14, respectively, for durability.

Figure 1B:
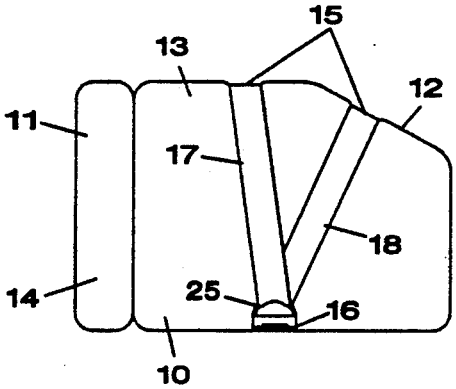
FIG. 1B is a side view of the drum damper of FIG. 1A.
Figure 2:
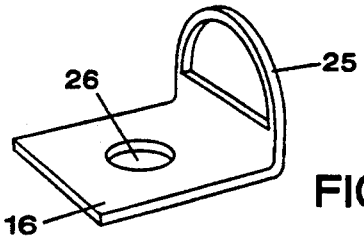
FIG. 2 is a perspective view of the fastening strap anchor.
Figure 3:
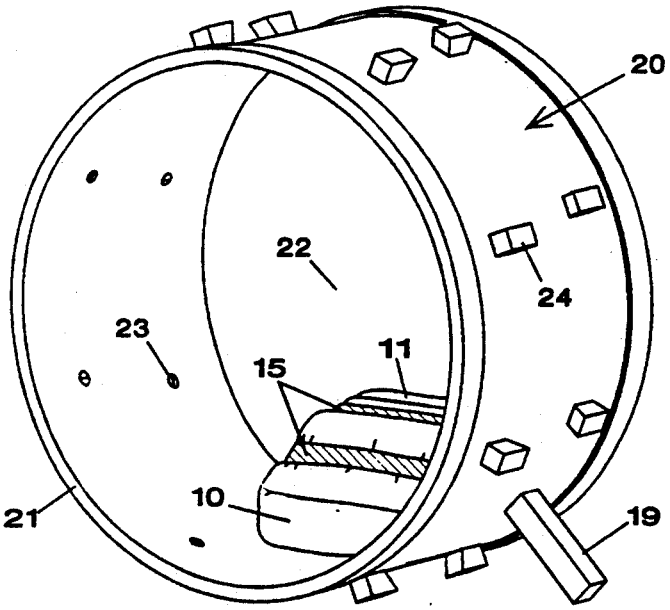
FIG. 3 is a rear perspective view of the drum damper in a drum.
Figure 4:
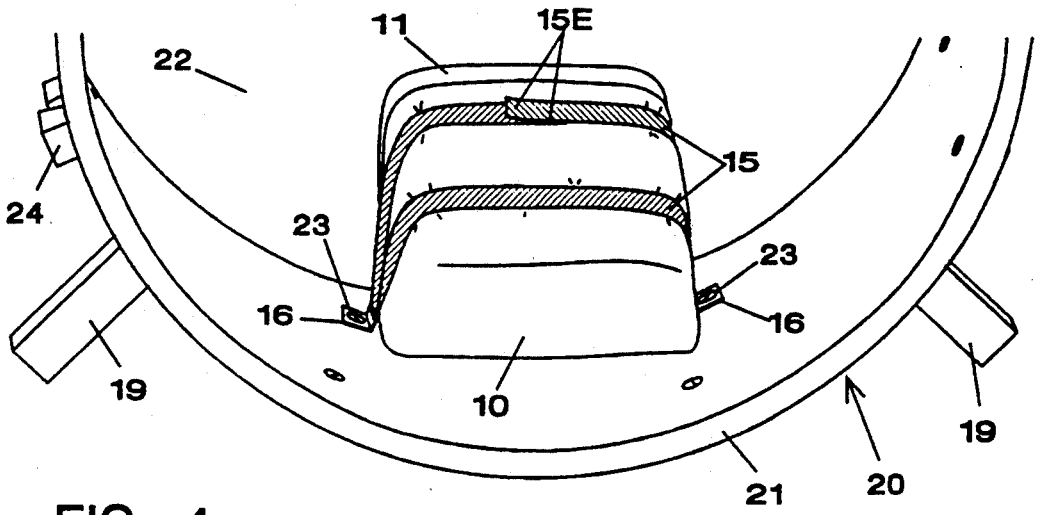
FIG. 4 is close up, rear perspective view of the drum damper in a drum.
Figure 5:
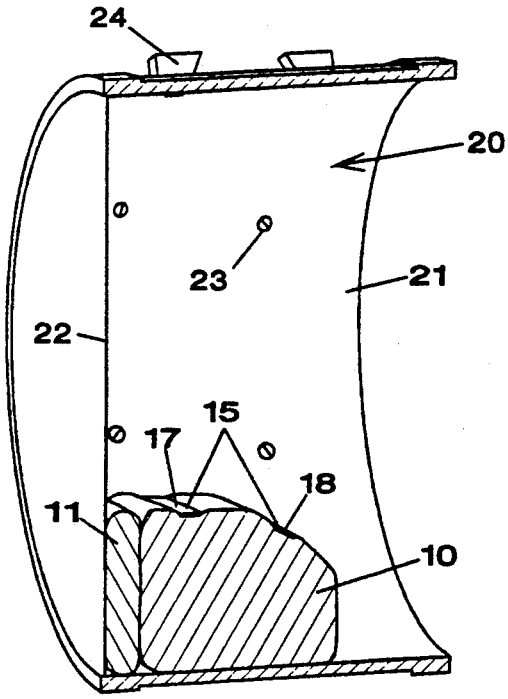
FIG. 5 is a sectional perspective view of the drum damper in a drum.

As shown in FIG. 1B, the drum damper is secured with a one-piece fastening strap 15 which loops through hoops 25 of anchors 16 (one shown) placed on either side of body 10. A front portion 17 of the strap holds down body 10, while a rear portion 18 pulls against slopped portion 12 to urge body 10 and cushion 11 forwardly.

DESCRIPTION—FIG. 2

Anchor 16 is shown here in a perspective view. Anchor 16, preferably made of steel, is L-shaped and has a vertical hoop 25 on one leg and a screw hole 26 on the other leg.

DESCRIPTION—FIG. 3

Here the drum damper is shown, in a rear perspective view, mounted in a vertically positioned base drum 20. Fastening strap 15 holds body 10 against the drum shell 21 and body 10 in turn holds cushion 11 against the drum head 22. Drum 20 has screws 23 distributed evenly around the interior for holding head clamps 24. Screws 23 and clamps 24 are common to al professional quality drums. Legs (only one is shown) at 19 prevent drum 20 from rolling.

DESCRIPTION—FIG. 4

In this close-up rear perspective view of the drum damper, anchors 16 are shown attached to drum shell 21 with two of clamp-holding screws 23. Because screws 23 exist in all professional quality drums, anchors 16 can be attached to drum 20 by simply removing and reattaching two screws through holes 26 of the anchors. The width of anchor 16 is selected so that existing screws 23 can be so utilized. Fastening strap 15 is looped through both anchors 16 and pulled tight to firmly hold down the drum damper. Ends 15E of fastening strap 15 are held together with hook-and-loop fasteners (not shown) which extend about 8 cm on each end portion to permit adjustability.

DESCRIPTION—FIG. 5

Here the drum damper and drum 20 are shown in a sectional perspective view. Front portion 17 of fastening strap 15 holds body 10 down against drum shell 21, while rear portion 18 of the strap pulls body 10 and cushion 11 against drum head 22. The degree of compression of cushion 11 against drum head 22 can be adjusted manually, and thereafter reliably maintained by loosening and retightening fastening strap 15 using the hook-and-loop fasteners between ends 15E. The amount of overtone reduction achieved by the damper is directly related to the degree of compression between cushion 11 and drum head 22. Therefore, the tighter cushion 11 is pushed against drum head 22, the more overtone reduction is achieved. The compression of cushion 11 against drum head 22, and therefore the amount of overtone reduction, can be adjusted to suit the personal tastes of the drummer nd the acoustics of the playing environment. I presently prefer to (a) reduce overtones in large rooms or rooms without sound damping materials (bare walls, no rugs), and (b) increase overtones in smaller rooms with sound damping materials (curtains, rugs).

The drum damper will remain firmly in position within drum 20 regardless of the orientation of the drum. Strap 15 holds cushion 11 and body 10 securely enough such that the damper will not shift position even after prolonged drum play. Therefore, the damper will produce consistent, reliable, and predictable performance.

In one embodiment of the invention, cushion 11 is 215 mm wide, 165 mm high, and 50 mm thick, while body is 215 mm wide and 165 mm high so its surface area in contact with head 22 is about $215 \times 165 = 35{,}000$ mm$^2$. cushion 11 is also about 230 mm long. This size is suitable for drums of between 500 mm and 550 mm diameter. Thus a 500 mm diameter drum has a head area of about $\pi \times (500/2)^2 = 200{,}000$ mm$^2$, so that, as shown, the surface of cushion 11 contacts less than about 25% of head area. The damper can be made in several sizes to suit drums of proportionate sizes.

SUMMARY, RAMIFICATIONS, AND SCOPE

Accordingly the reader will see that I have provided an improved drum damper which can significantly reduce drum overtones. It may be easily adjusted for various degrees of overtone reduction by adjusting the compression between cushion 11 and drum head 22. It may be easily adjusted to allow drums to produce desired amounts of overtone to suit the personal tastes of drummers and the acoustics of the plying environment. It is completely reliable and consistent in performance because fastening strap 15 firmly holds the damper in place. It is durable because it is made of resilient foam and strong fabric materials. It is compact nd easily transportable. It may easily installed on a drum using the drum's existing screws. It may be easily removed. It is simple and economical to manufacture.

While the above descriptions are specific, they should not be considered as limitations on the scope of the invention, but only as examples of the preferred embodiment. Many other ramifications and variations are possible within the teachings of the invention. For example, the components may be made of different materials. Cushion 11 may be made as an integral part of body 10. Different types of anchors and fastening straps may be used. E.g., metal rods with turnbuckle tighteners, thumbscrew tighteners on threaded rods, etc., can be used. The fastening strap can alternatively be adjusted by using a buckle and pierced billet, a double buckle, a ratchet buckle, snap fasteners, a thrumbscrew strap puller, etc. The shaped of body 10 and cushion 11 may be altered. Body 10 and cushion 11 can be attached, e.g., by hook-and-loop fasteners, adhesive, sewing, or snap fasteners. Fastening strap 15 may be permanently attached to body 10. The damper may be attached to drums without internal screws by simply drilling two holes in the drum shell.

Thus the reader is requested to determine the scope of the invention by the appended claims and their legal equivalents, and not by the examples given.

I claim:

1. A drum damper for a drum having a flat head and a cylindrical supporting shell which is concentric about an axis which is perpendicular to said head, said drum damper comprising:

cushion means comprising a body of soft, resilient damping material for altering the tonal characteristics of said drum, fastening means for securely attaching and holding said cushion means in compression against (1) a peripheral portion of said head so that said cushion means is in an off-center position of said head, and (2) an adjacent portion of said cylindrical supporting shell of said drum, said fastening means comprising strap means and a pair of anchors attaching said strap means to said cylindrical supporting shell of said drum, said strap means including adjustment means for allowing adjustment of the amount of said compression so that said tonal characteristics of said drum can be adjusted, said strap means including two strap sections extending across spaced portions of said cushion means, one of said strap sections being positioned so as to exert force to urge said cushion means against said head, the other of said strap sections being positioned so as to urge said cushion means against said cylindrical supporting shell, whereby said cushion means will be held securely in position against said head and said cylindrical supporting shell despite active striking of said drum, said cushion means having a surface which contacts less than about 25% of the area of said head, whereby said cushion means will not damp excessive overtones of said drum.

2. The drum damper of claim 1 wherein said anchors comprise a pair of L-shaped members fastened to said cylindrical supporting shell on two respective sides of said cushion means, on leg of each L-shaped member having a hoop, and wherein said strap means extends through said hoops of said L-shaped members and is doubly looped over said cushion means.

3. The drum damper of claim 2 wherein said adjustment means comprises a pair of hook-and-loop fastening portions attached to a pair of ends of said strap means for adjusting the tension in said strap means.

4. The drum damper of claim 1, further including a body for supposing said cushion means, said body being more rigid than said cushion means.

5. The drum damper of claim 4 wherein said body comprises a block of dense foam.

6. The drum damper of claim 4 wherein said body has a sloped rear portion, said one of said sections of said strap means extending over said sloped rear portion.

7. The drum damper of claim 1, wherein said adjustment means comprises a pair of hook-and-loop fastening portions attached to a pair of ends of said strap means for adjusting tension of said strap means.

* * * * *

UNITED STATES PATENT AND TRADEMARK OFFICE

CERTIFICATE OF CORRECTION

PATENT NO. : 5,233,898

DATED : August 10, 1993

INVENTOR(S) : Anthony Montano

It is certified that error appears in the above-indentified patent and that said Letters Patent is hereby corrected as shown below:

Col. 1, line 12, change "mot" to --most--
Col. 3, line 11, change "al" to --all--
Col. 3, line 47, change "nd" to --and--
Col. 4, line 16, change "nd" to --and--
Col. 4, line 17, after "may" should read --be--

Signed and Sealed this

Eighth Day of March, 1994

Bruce Lehman

*Attest:*

BRUCE LEHMAN

*Attesting Officer*

*Commissioner of Patents and Trademarks*